US010145128B2

(12) United States Patent
Woodward et al.

(10) Patent No.: US 10,145,128 B2
(45) Date of Patent: Dec. 4, 2018

(54) INTERLOCKING WORK PLATFORM SYSTEM AND METHOD

(71) Applicants: Steve Woodward, Meadville, PA (US); Joseph C. Dangrow, Mercer, PA (US); Michael A. Somerfield, Hermitage, PA (US)

(72) Inventors: Steve Woodward, Meadville, PA (US); Joseph C. Dangrow, Mercer, PA (US); Michael A. Somerfield, Hermitage, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 15/382,061

(22) Filed: Dec. 16, 2016

(65) Prior Publication Data

US 2018/0171648 A1 Jun. 21, 2018

(51) Int. Cl.

| | |
|---|---|
| ***E04G 1/15*** | (2006.01) |
| ***E04G 1/34*** | (2006.01) |
| ***E04G 1/32*** | (2006.01) |

(52) U.S. Cl.

CPC ..... *E04G 1/15* (2013.01); *E04G 1/32* (2013.01); *E04G 1/34* (2013.01); *E04G 2001/157* (2013.01)

(58) Field of Classification Search

CPC .. E04G 1/15; E04G 1/132; E04G 1/34; E04G 2001/157; E04G 1/28; E04G 2001/302

See application file for complete search history.

(56) References Cited

U.S. PATENT DOCUMENTS

| | | | | | |
|---|---|---|---|---|---|
| 1,520,518 | A | * | 12/1924 | Thomason | A47B 87/002 108/64 |
| 2,851,311 | A | * | 9/1958 | Gibbs | E04G 1/28 108/185 |
| 3,547,227 | A | * | 12/1970 | Trevino | E04G 1/32 182/186.1 |
| 5,029,671 | A | * | 7/1991 | Larson | B60S 5/00 182/131 |
| 5,358,069 | A | * | 10/1994 | Krause | E04G 1/154 182/118 |
| 5,746,288 | A | * | 5/1998 | O'Neal | E04G 1/34 182/118 |

(Continued)

FOREIGN PATENT DOCUMENTS

| | | | | |
|---|---|---|---|---|
| DE | 19904411 A1 | * | 8/2000 | E04G 1/32 |
| DE | 102007037771 A1 | * | 2/2009 | E04G 1/28 |
| DE | 102007045788 A1 | * | 5/2009 | E04G 1/28 |

*Primary Examiner* — Alvin C Chin-Shue

(74) *Attorney, Agent, or Firm* — Ansel M. Schwartz

(57) ABSTRACT

A work platform system having a first work platform. The system having a first bracket attached to the first scaffold and extending below and outward beyond the first scaffold between the first rail and the second rail of the first leg assembly. The system having a second bracket attached to the first scaffold and extending below and outward beyond the first scaffold between the first rail and the second rail of the first leg assembly. The system having a second work platform. The first end of the second scaffold is disposed on the first bracket and the second bracket with the first bracket and the second bracket extending between the first rung of the third leg assembly and the second scaffold. A method for using a work platform system.

5 Claims, 15 Drawing Sheets

(56) References Cited

U.S. PATENT DOCUMENTS

| | | | | |
|---|---|---|---|---|
| 7,686,134 | B1 * | 3/2010 | Harris | E04G 1/36<br>182/200 |
| 2004/0238280 | A1 * | 12/2004 | Gibson | E04G 1/28<br>182/153 |
| 2010/0282540 | A1 * | 11/2010 | Moss | B25H 1/06<br>182/119 |

* cited by examiner

WHEN TWO OR MORE UNITS ARE LINKED TOGETHER, FOLLOW THESE STEPS TO POSITION THE HOOKS AND LINK THE UNITS.

INTERLOCKING WORK PLATFORM SYSTEM AND METHOD

FIELD OF THE INVENTION

The present invention pertains to a work platform system formed by connecting two work platforms together to move from one platform to the other without getting off either platform to do so. (As used herein, references to the "present invention" or "invention" relate to exemplary embodiments and not necessarily to every embodiment encompassed by the appended claims.) More specifically, the present invention pertains to a work platform system formed by connecting two work platforms together to move from one platform to the other without getting off either platform to do so where the work platforms are locked together with brackets.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Scaffolds are commonly used to provide artisans with the ability to work across longer elevated spaces than they otherwise could on a ladder. In many instances, the longer the elevated work spaces the better for the artisans because they then do not have to climb down off the work platform to move the work platform to a new location to access a new elevated workspace in which they need to work. One way to provide a longer elevated workspace is to provide for individual longer work platforms. However the larger the work platform becomes, the heavier it becomes and the more effort is needed to move the work platform when needed.

Another way to accomplish a longer elevated space is to connect 2 or more individual work platforms together to effectively double the elevated workspace that would otherwise be available for only one workspace. However, when combining to individual work platforms together, care must be taken they are securely and safely connected, as well as they can be quickly and easily connected together.

BRIEF SUMMARY OF THE INVENTION

The present invention pertains to a work platform system. The system comprises a first work platform comprising a first scaffold having a first end and a second end upon which a user can stand. The first work platform comprises a first leg assembly rotatably attached with bolts to the first end of the first scaffold having a first rail and a second rail and a rung attached to the first rail and the second rail. The first leg assembly in a folded position relative to the first scaffold and essentially in parallel with the plane of the first scaffold. The first work platform comprises a second leg assembly rotatably attached with bolts to the second end of the first scaffold. The second leg assembly is in an open position relative to the first scaffold and essentially perpendicular to the plane of the first scaffold.

The system comprises a first bracket attached to the first scaffold and extending below and outward beyond the first scaffold between the first rail and the second rail of the first leg assembly. The system comprises a second bracket attached to the first scaffold and extending below and outward beyond the first scaffold between the first rail and the second rail of the first leg assembly.

The system comprises a second work platform. The second work platform comprises: a second scaffold having a first end and a second end and a plane upon which the user can stand; the second work platform comprises a third leg assembly rotatably attached with bolts to the first end of the second scaffold having a first rail and a second rail and a rung attached to the first rail and the second rail of the third leg assembly. The third leg assembly is in an open position relative to the second scaffold and essentially perpendicular to the plane of the second scaffold.

The first end of the second scaffold is disposed on the first bracket and the second bracket with the first bracket and the second bracket extending between the first rung of the third leg assembly and the second scaffold. The first bracket and the second bracket are disposed on the first rung of the third leg assembly. The first work platform is locked to the second work platform through the first and second brackets engaging with the second scaffold and the rung of the third leg assembly. The second work platform comprises a fourth leg assembly rotatably attached with bolts to the second end of the second scaffold. The second leg assembly of the second scaffold is in an open position relative to the second scaffold and essentially perpendicular to the plane of the second scaffold.

The present invention pertains to a method for using a work platform system. The method comprises the steps of putting a first leg assembly of a first work platform and a folded positioned essentially in parallel with a first scaffold of the first work platform. There is the step of putting a second leg assembly of the first work platform in an open position essentially perpendicular to the first scaffold. There is the step of inserting a first bracket and a second bracket extending from a first side of the first scaffold between a rung of a third leg assembly of a second work platform and a second scaffold of the second work platform while the third leg assembly is in a partially open position, which is between a folded position where the third leg assembly is essentially in parallel with the second scaffold and an open position where the third leg assembly is essentially perpendicular with the second scaffold. There is the step of moving the third leg assembly with the first and second brackets between the rung of the third leg assembly and the second scaffold into the open position to lock the first and second brackets to the second work platform. There is the step of positioning the first and second work platforms which are locked together at a desired location so the first and second work platforms rest on the second leg assembly of the first work platform and the third leg assembly and a fourth leg assembly of the second work platform but not the first leg assembly.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
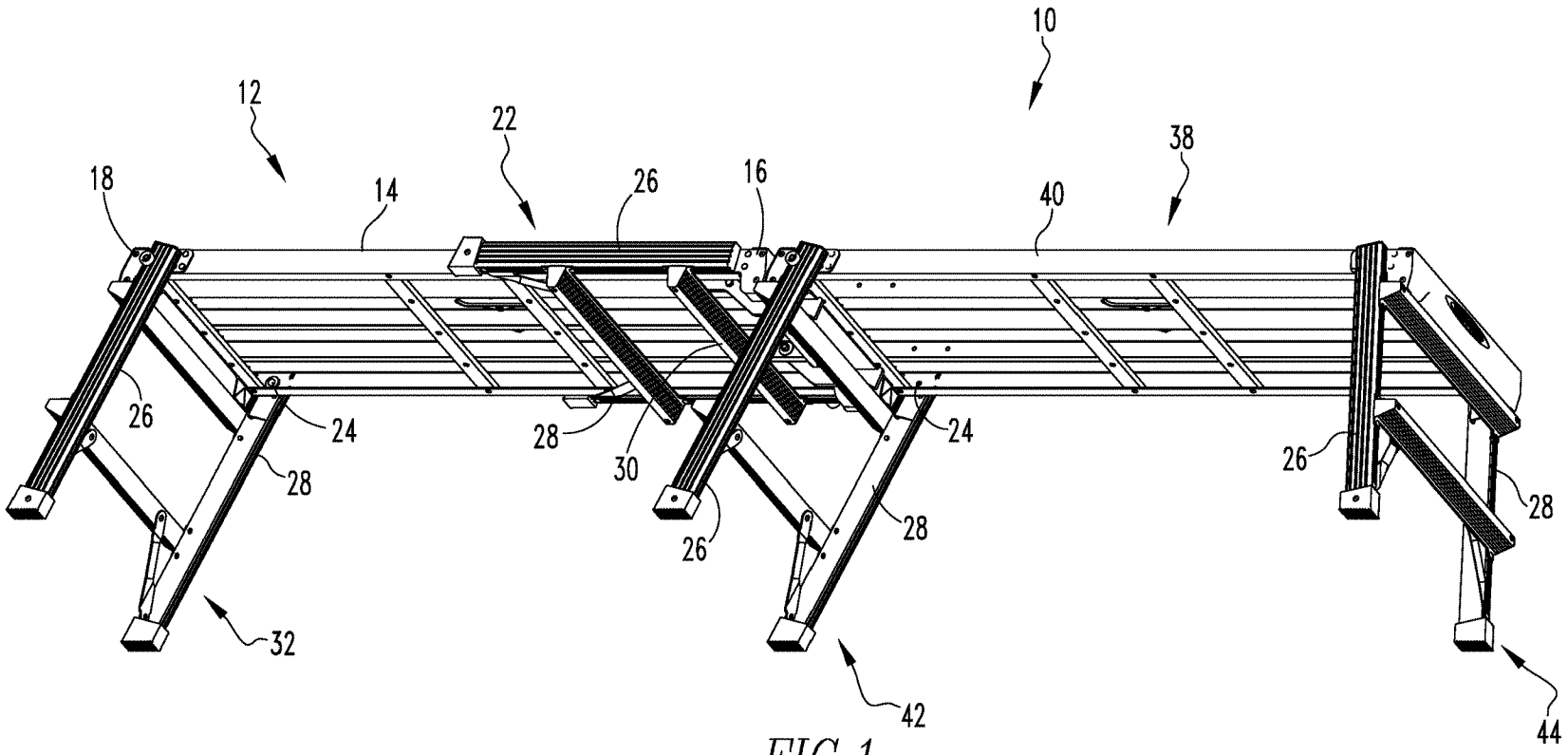
FIG. 1 is a perspective view of an interlocking work platform system with a first work platform locked to a second work platform of the present invention.
Figure 2:
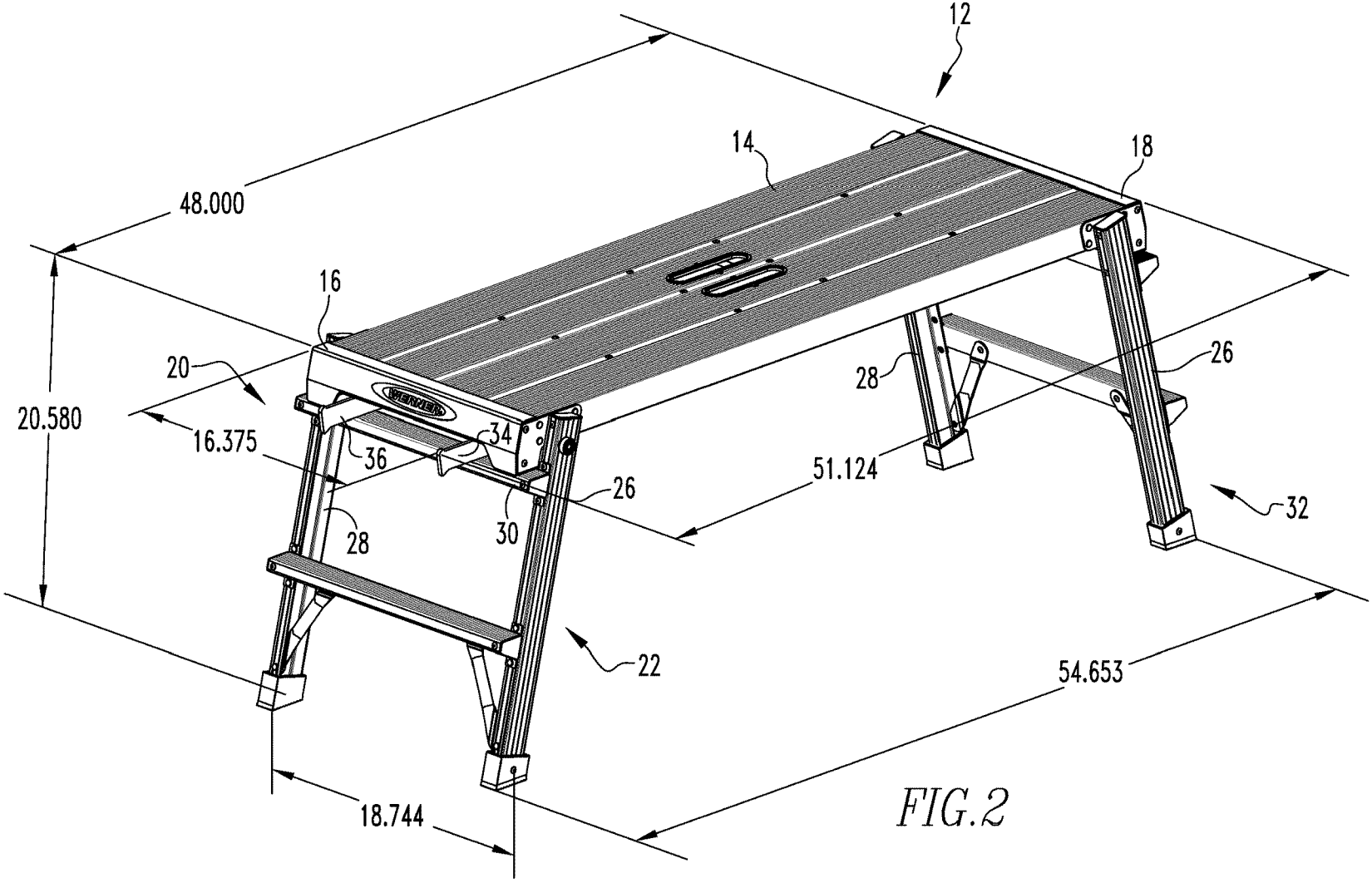
FIG. 2 is a perspective view of the first work platform.
Figure 3:
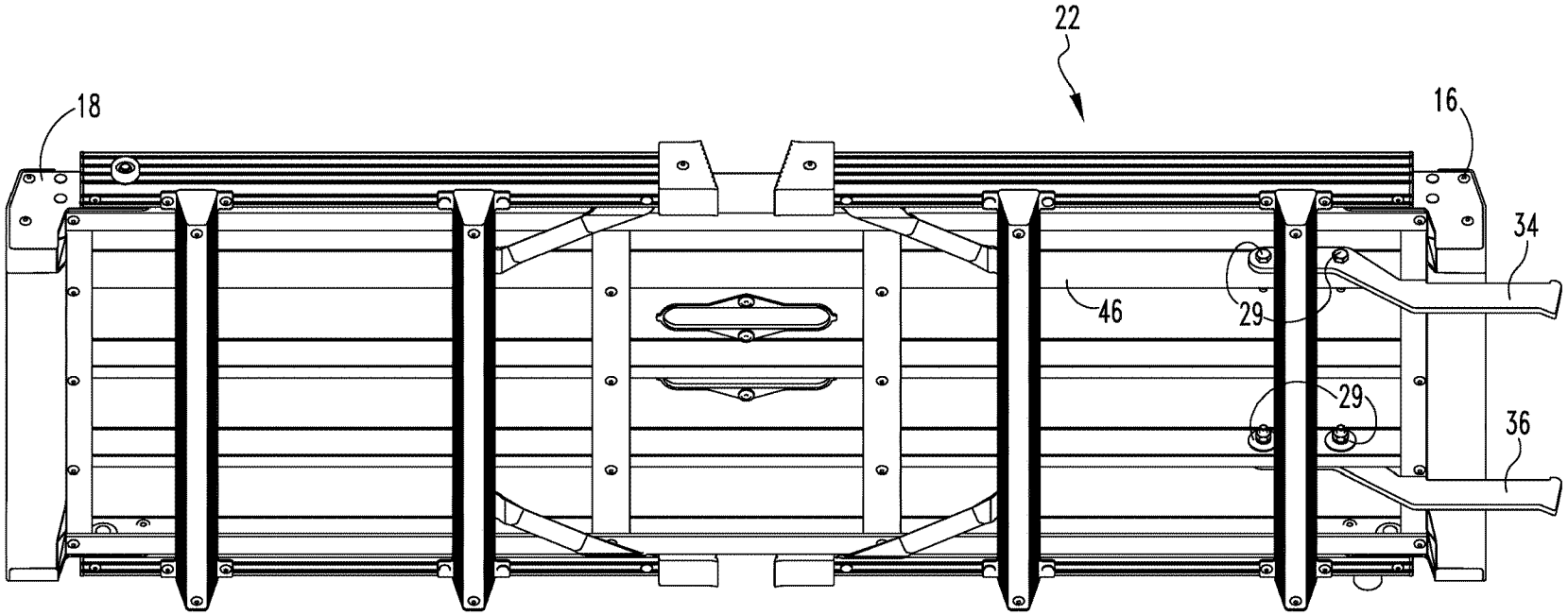
FIG. 3 is an underside view of the first work platform in a folded position.

Referring now to the drawings wherein like reference numerals refer to similar or identical parts throughout the several views, and more specifically to FIGS. 1-3 thereof, there is shown a work platform system 10. The system 10 comprises a first work platform 12 comprising a first scaffold 14 having a first end 16 and a second end 18 and a plane 20 upon which a user can stand. The first work platform 12 comprises a first leg assembly 22 rotatably attached with rivets 24 to the first end 16 of the first scaffold 14 having a first rail 26 and a second rail 28 and a rung 30 attached to the first rail 26 and the second rail 28. The first leg assembly 22 in a folded position relative to the first scaffold 14 and essentially in parallel with the plane 20 of the first scaffold 14. The first work platform 12 comprises a second leg assembly 32 rotatably attached with rivets 24 to the second end 18 of the first scaffold 14. The second leg assembly 32 is in an open position relative to the first scaffold 14 and essentially perpendicular to the plane 20 of the first scaffold 14.

The system 10 comprises a first bracket 34 attached to the first scaffold 14 and extending below and outward beyond the first scaffold 14 between the first rail 26 and the second rail 28 of the first leg assembly 22. The system 10 comprises a second bracket 36 attached to the first scaffold 14 and extending below and outward beyond the first scaffold 14 between the first rail 26 and the second rail 28 of the first leg assembly 22. The brackets may be made out of steel or aluminum.

The system 10 comprises a second work platform 38. The second work platform 38 comprises: a second scaffold 40 having a first end 16 and a second end 18 and a plane 20 upon which the user can stand; the second work platform 38 comprises a third leg assembly 42 rotatably attached with rivets 24 to the first end 16 of the second scaffold 40 having a first rail 26 and a second rail 28 and a rung 30 attached to the first rail 26 and the second rail 28 of the third leg assembly 42. The third leg assembly 42 is in an open position relative to the second scaffold 40 and essentially perpendicular to the plane 20 of the second scaffold 40.

The first end 16 of the second scaffold 40 is disposed on the first bracket 34 and the second bracket 36 with the first bracket 34 and the second bracket 36 extending between the first rung 30 of the third leg assembly 42 and the second scaffold 40. The first bracket 34 and the second bracket 36 are disposed on the first rung 30 of the third leg assembly 42. The first work platform 12 is locked to the second work platform 38 through the first and second brackets 34, 36 engaging with the second scaffold 40 and the rung 30 of the third leg assembly 42. The second work platform 38 comprises a fourth leg assembly 44 rotatably attached with rivets 24 to the second end 18 of the second scaffold 40. The second leg assembly 32 of the second scaffold 40 is in an open position relative to the second scaffold 40 and essentially perpendicular to the plane 20 of the second scaffold 40. No pins or bands or any additional components may be used to lock the first work platform 12 with the second work platform 38. The first scaffold 14 has a first crossbar 46 disposed under the first scaffold 14 along a length of the first scaffold 14 and a second crossbar disposed under the first scaffold 14 along a length of the first scaffold 14 in parallel and spaced relation with the first crossbar 46. The first bracket 34 may be bolted to the first crossbar 46 and the second bracket 36 may be bolted to the second crossbar.

Figure 4:
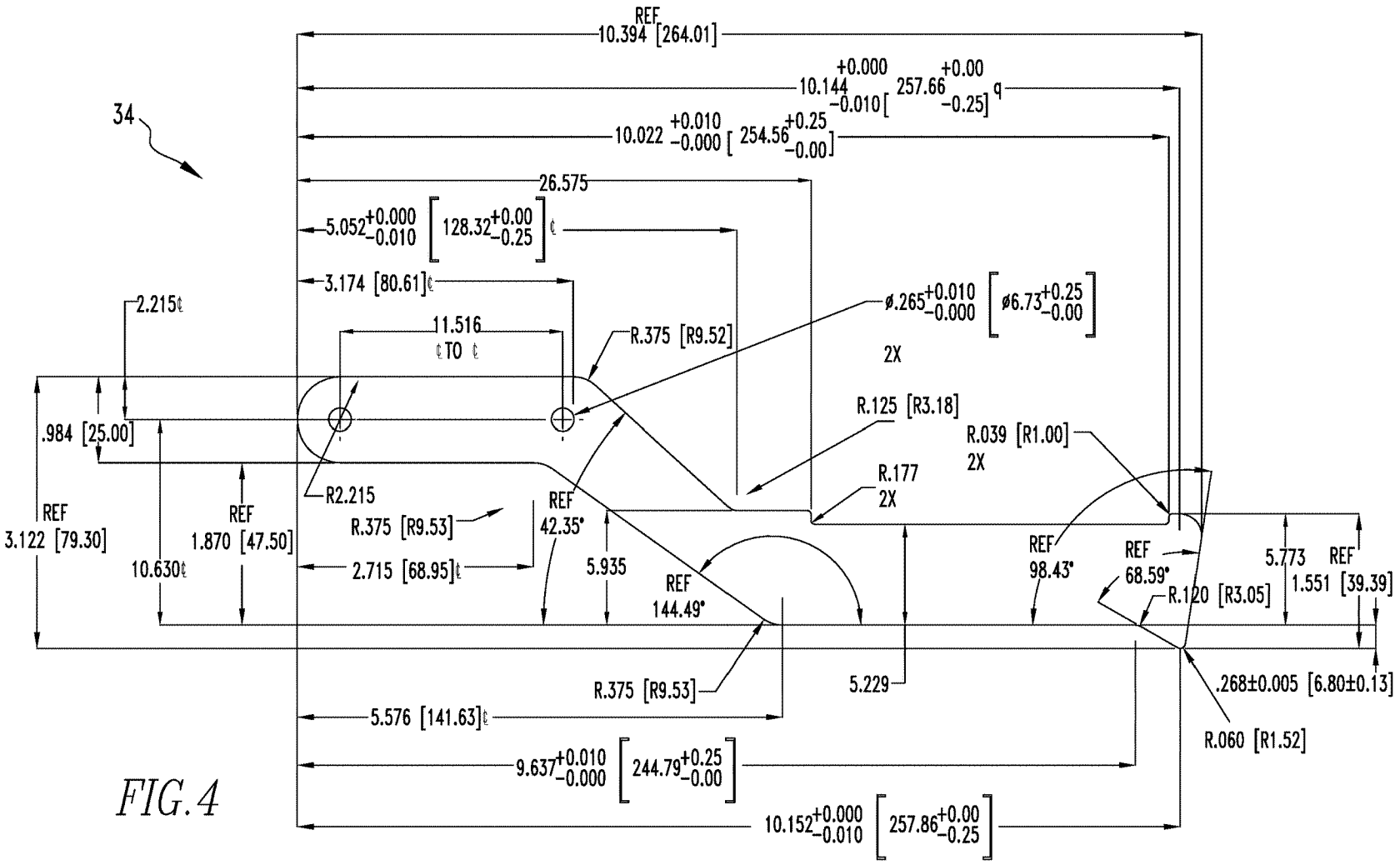
FIG. 4 is a side view of the first bracket and the open position.
Figure 5:
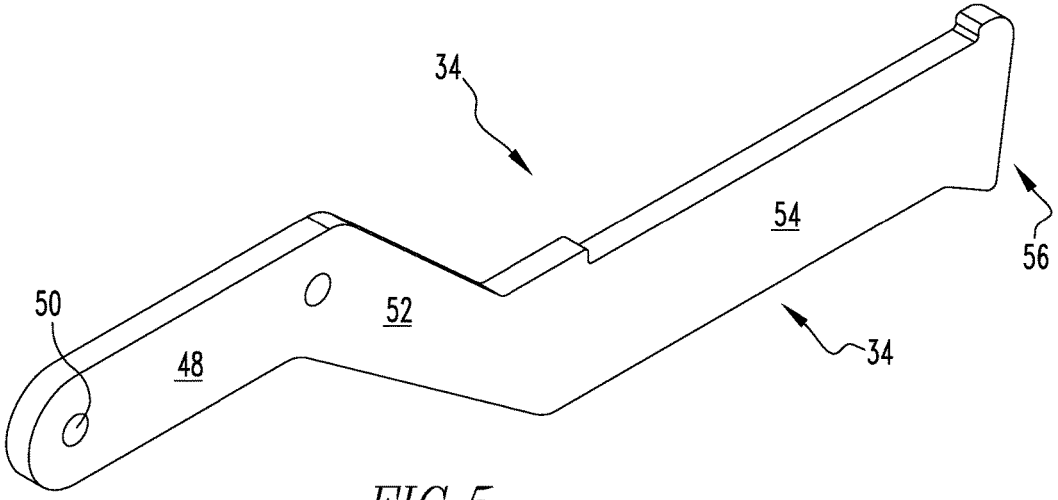
FIG. 5 is a perspective view of the first bracket.
Figure 6:
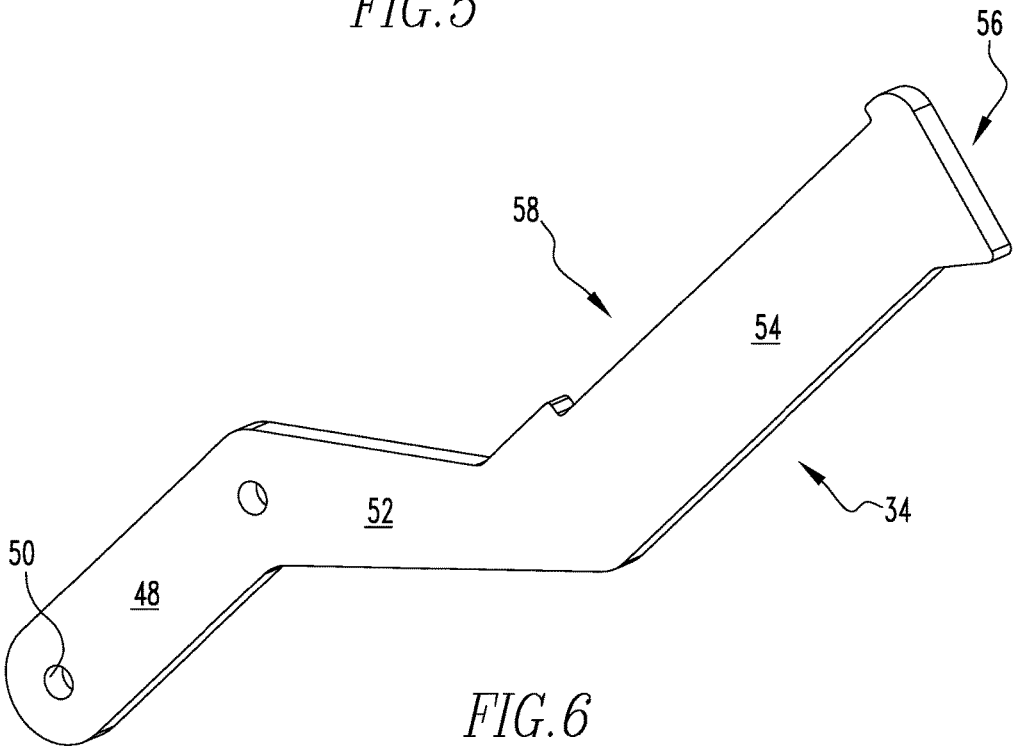
FIG. 6 is a perspective view of the first bracket.

The first bracket 34 may have a first portion 48, as shown in FIGS. 4, 5 and 6, which is somewhat rectangularly shaped and has a bolthole 50 through which a bolt 29 extends to bolt the first bracket 34 to the first crossbar 46, a second portion 52 which is somewhat rectangularly shaped and extends downward at an angle between 20° and 70° from the first portion 48, and a third portion 54 that is somewhat rectangularly shaped that extends from the second portion 52 essentially in parallel with the first portion 48. The third portion 54 extends between the rung 30 of the third leg assembly 42 and the second scaffold 40 and is disposed on the rung 30 of the third leg assembly 42 and on which the first end 16 of the second scaffold 40 is disposed.

The third portion 54 has a free end 56 that flares outward. By flaring outward, hooks 60 are defined, which facilitates the locking of the first work platform 12 with the second work platform 38 and serves to make it difficult for the first work platform 12 to separate from the second work platform 38 before they are locked together. On the top surface of the third portion 54 there is a notch 58, as shown in FIG. 6, that is of a size that is slightly larger than the width of the first end 16 of the second scaffold 40, so the first end 16 of the second scaffold 40 fits into the notch 58, and is then properly aligned.

Figure 8A:
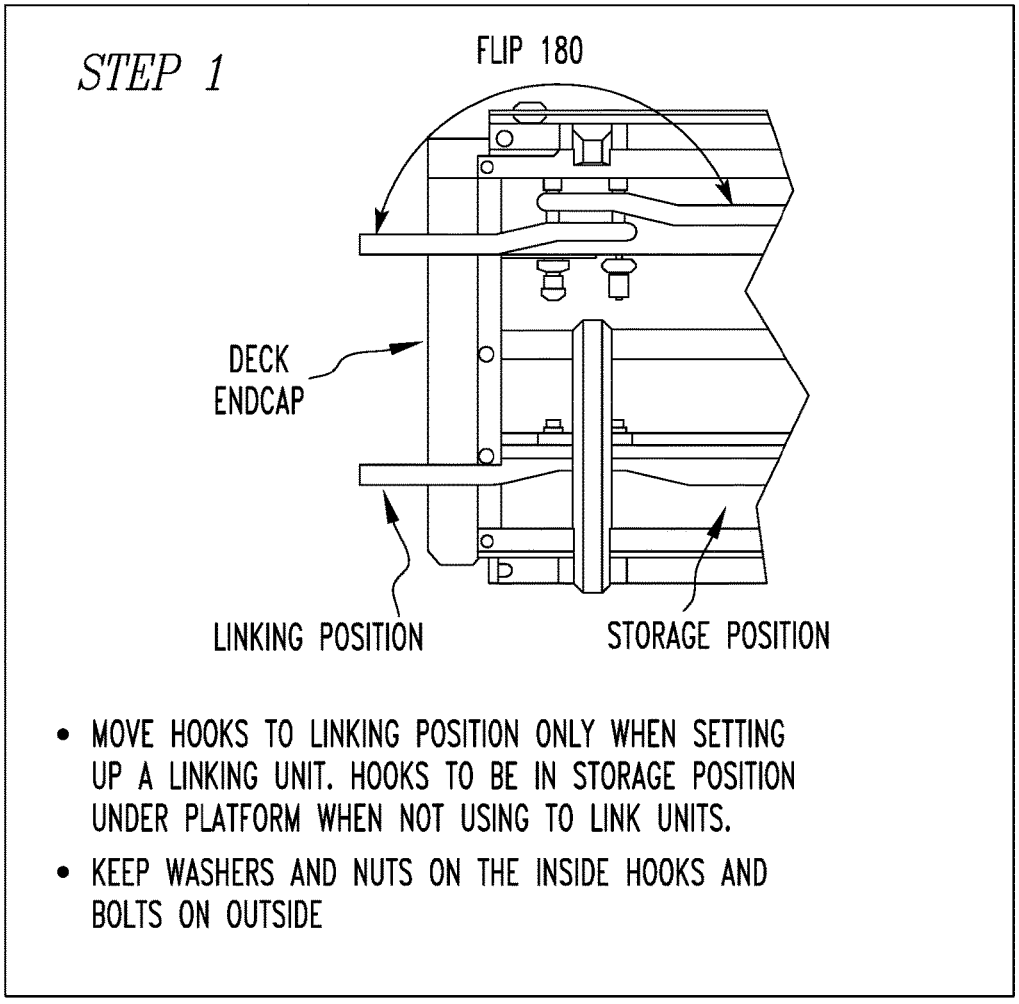
FIGS. 8A, 8B, and 8C depict the method of the present invention.
Figure 8B:
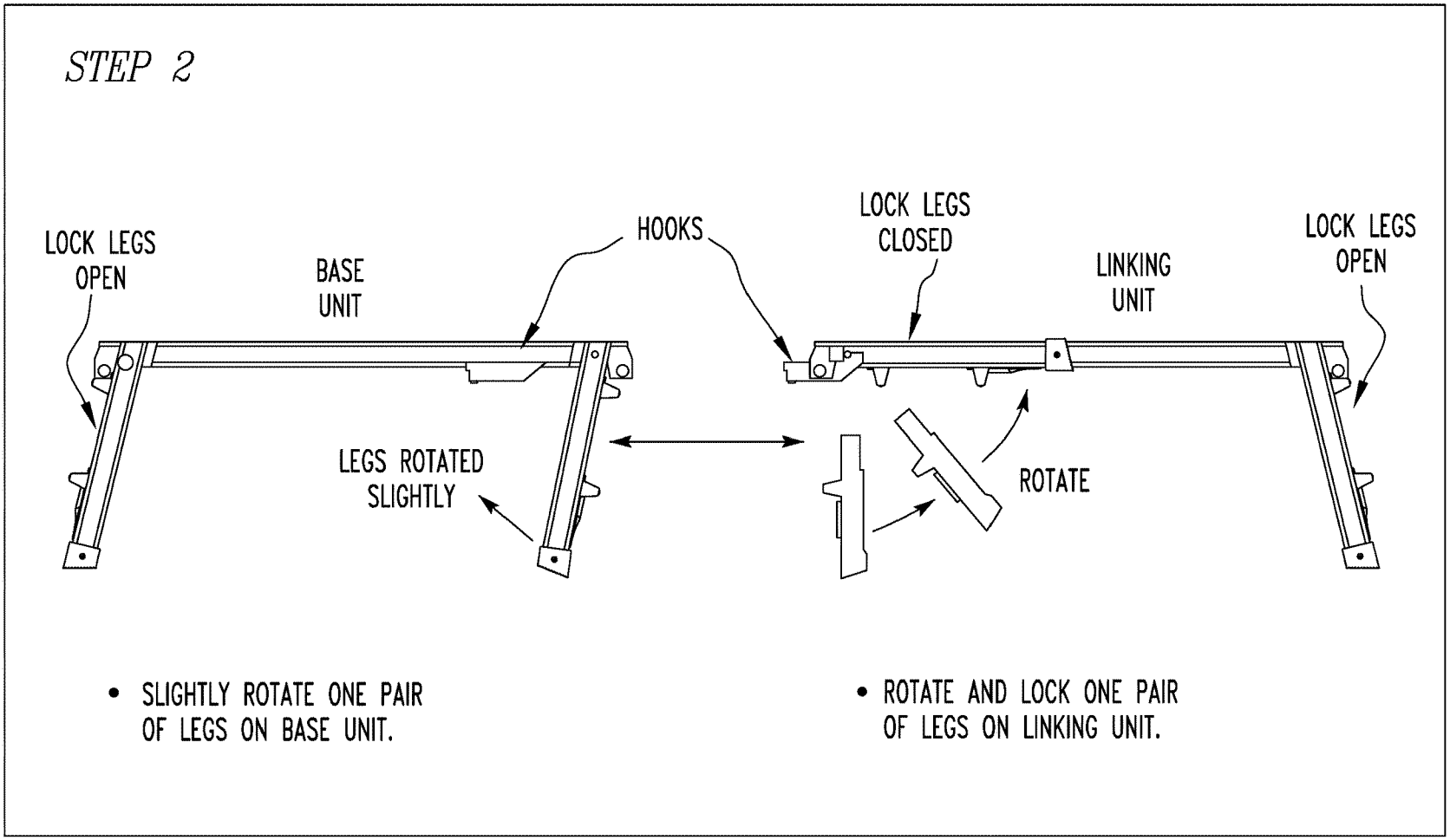
Figure 8C:
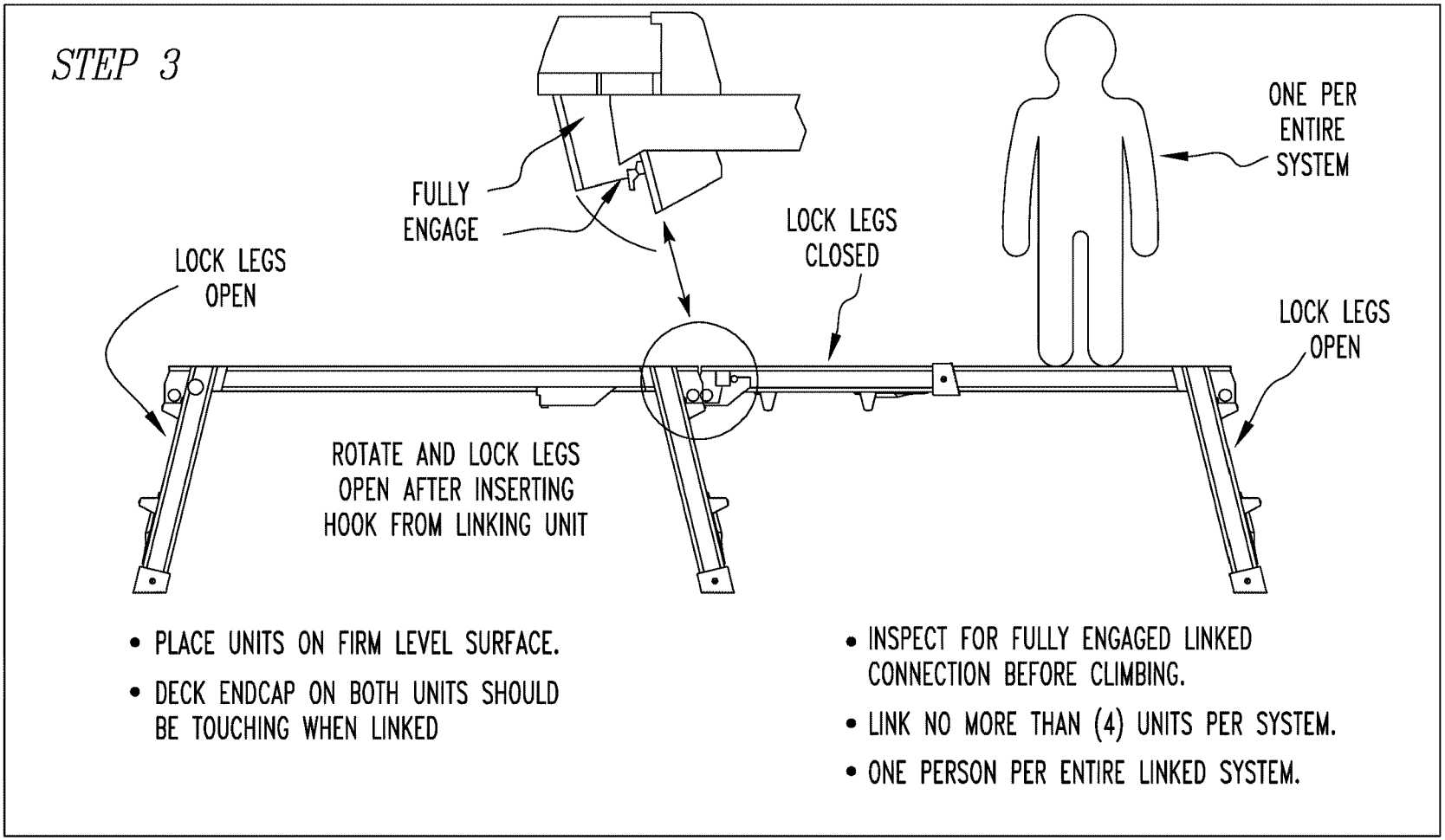

With reference to FIGS. 8A, 8B and 8C, the present invention pertains to a method for a work using a work platform system 10. The method comprises the steps of putting a first leg assembly 22 of a first work platform 12 and a folded positioned essentially in parallel with a first scaffold 14 of the first work platform 12. There is the step of putting a second leg assembly 32 of the first work platform 12 in an open position essentially perpendicular to the first scaffold 14. There is the step of inserting a first bracket 34 and a second bracket 36 extending from a first side of the first scaffold 14 between a rung 30 of a third leg assembly 42 of a second work platform 38 and a second scaffold 40 of the second work platform 38 while the third leg assembly 42 is in a partially open position, which is between a folded position where the third leg assembly 42 is essentially in parallel with the second scaffold 40 and an open position where the third leg assembly 42 is essentially perpendicular with the second scaffold 40. There is the step of moving the third leg assembly 42 with the first and second brackets 34, 36 between the rung 30 of the third leg assembly 42 and the second scaffold 40 into the open position to lock the first and second brackets 34, 36 to the second work platform 38. There is the step of positioning the first and second work platforms 12, 38 which are locked together at a desired location so the first and second work platforms 12, 38 rest on the second leg assembly 32 of the first work platform 12 and the third leg assembly 42 and a fourth leg assembly 44 of the second work platform 38 but not the first leg assembly 22.

Figure 7:
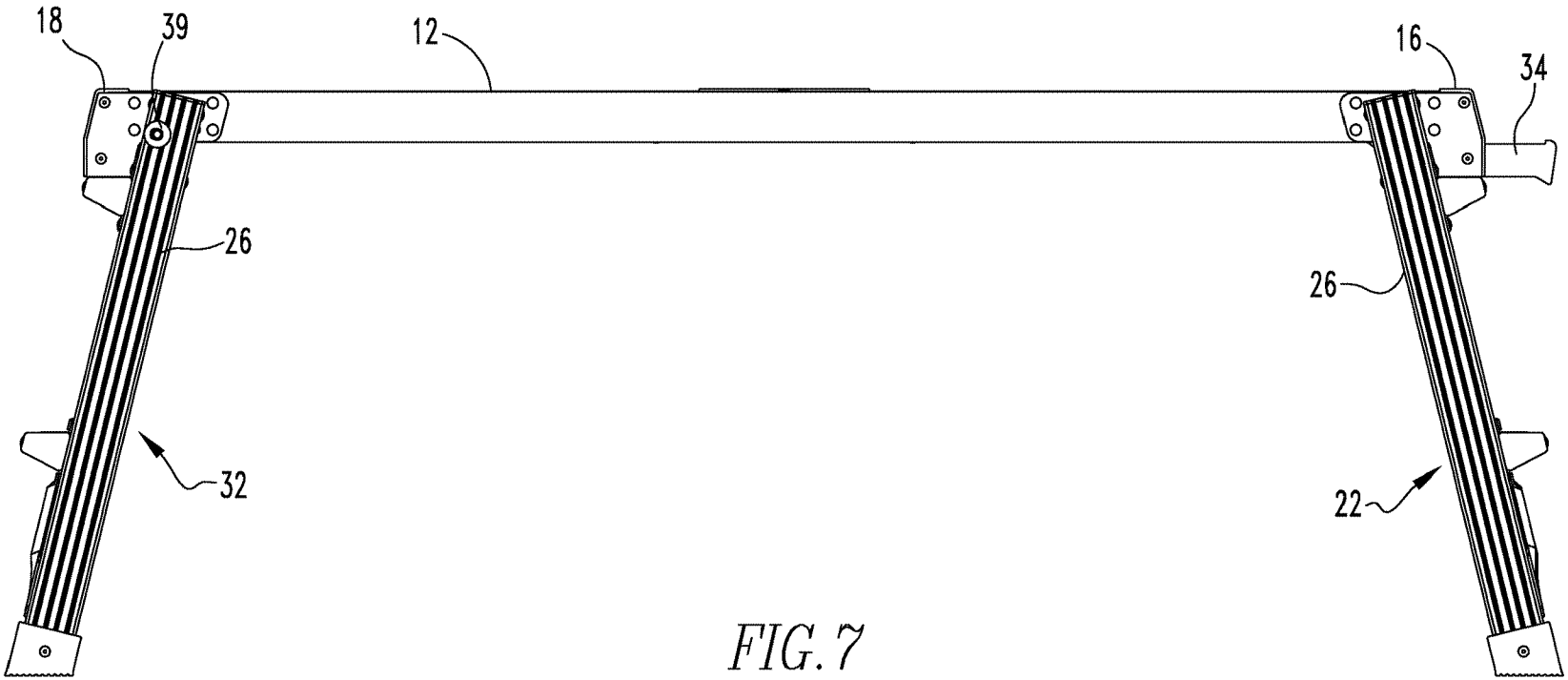
FIG. 7 is a side view of the first work platform.

By the third leg assembly 42 being in a partially open position, better enables the brackets to be placed between the rung 30 of the third ladder assembly and the first end 16 of the second scaffold 40. The brackets have more area to fit between the space when the third leg assembly 42 is in the partially open position. Once the brackets are properly positioned, the third ladder assembly is moved to the open position, effectively limiting movement of the brackets by the brackets being held tightly because the top rung 30 of the third leg assembly 42 and the first end 16 of the second scaffold 40 press against them to squeeze them or otherwise hold them in place with a positive force generated from the top rung 30 pushing the brackets against the first end 16 of the second scaffold 40, as shown in FIGS. 12-15. The third, fourth and second assemblies are then locked into their open position. Once the work platforms are in the open position, they are locked into the open position for use by moving the plunger-spring lock assembly 39, as shown in FIG. 7, into the locked position. The plunger-spring lock assembly 39 is well known in the art for locking work platforms in the open position.

The dimensions of the preferred embodiment of the first work platform 12 are shown in the figures. The first work platform supports at least 250 lbs. and preferably at least 500 lbs. without failure.

Figure 9:
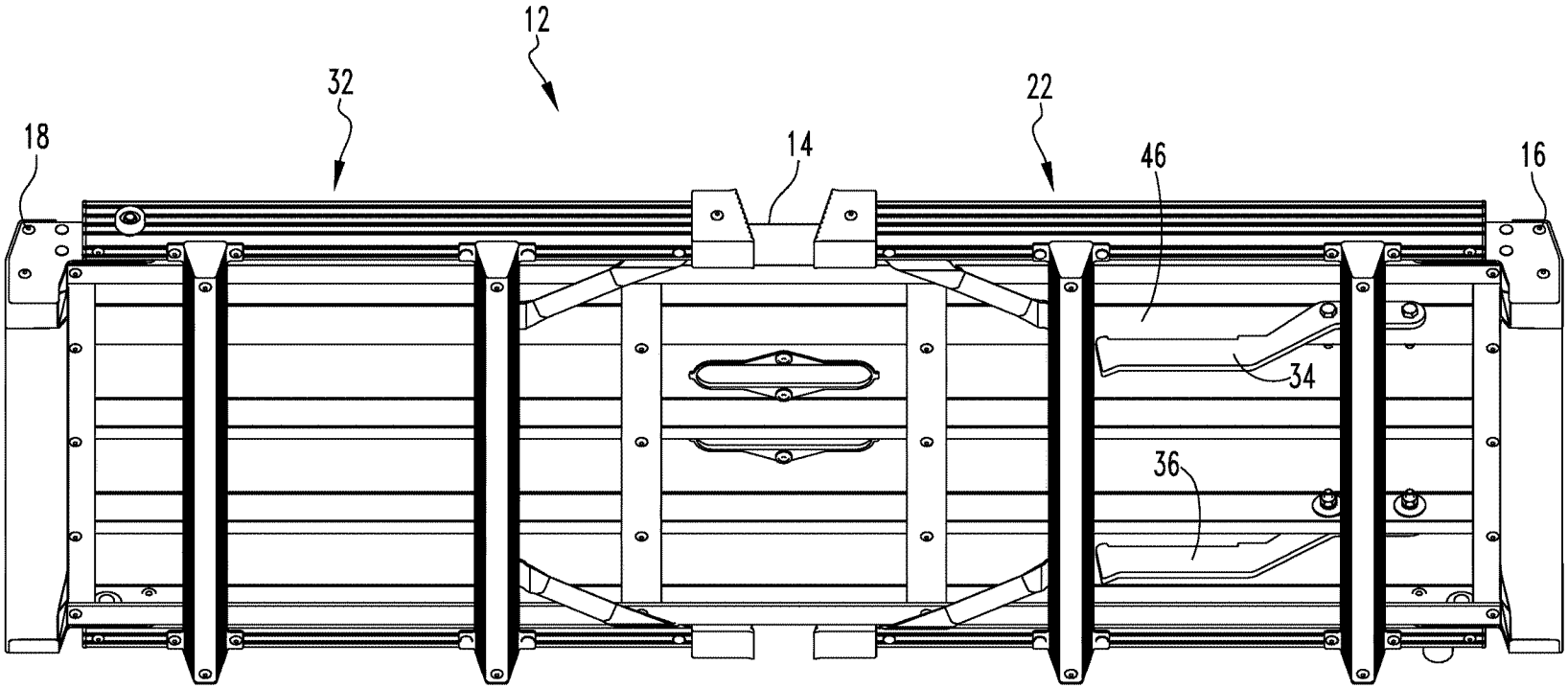
FIG. 9 is an underside view of the first work platform in the folded position with the first and second brackets in the transport position.
Figure 10:
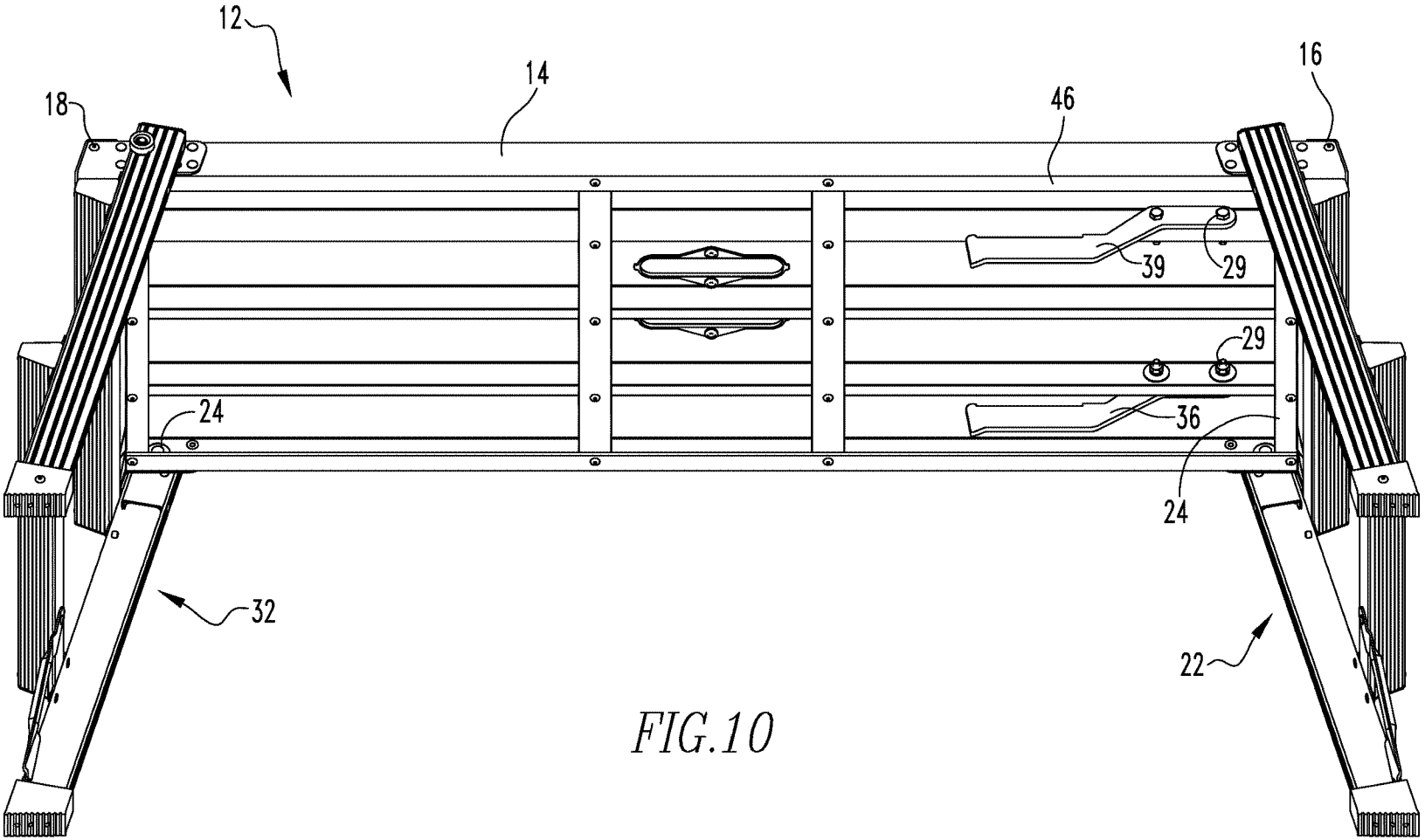
FIG. 10 is an underside perspective view of the first work platform in the open position with the first and second brackets in the transport position
Figures 11, 12, 13:
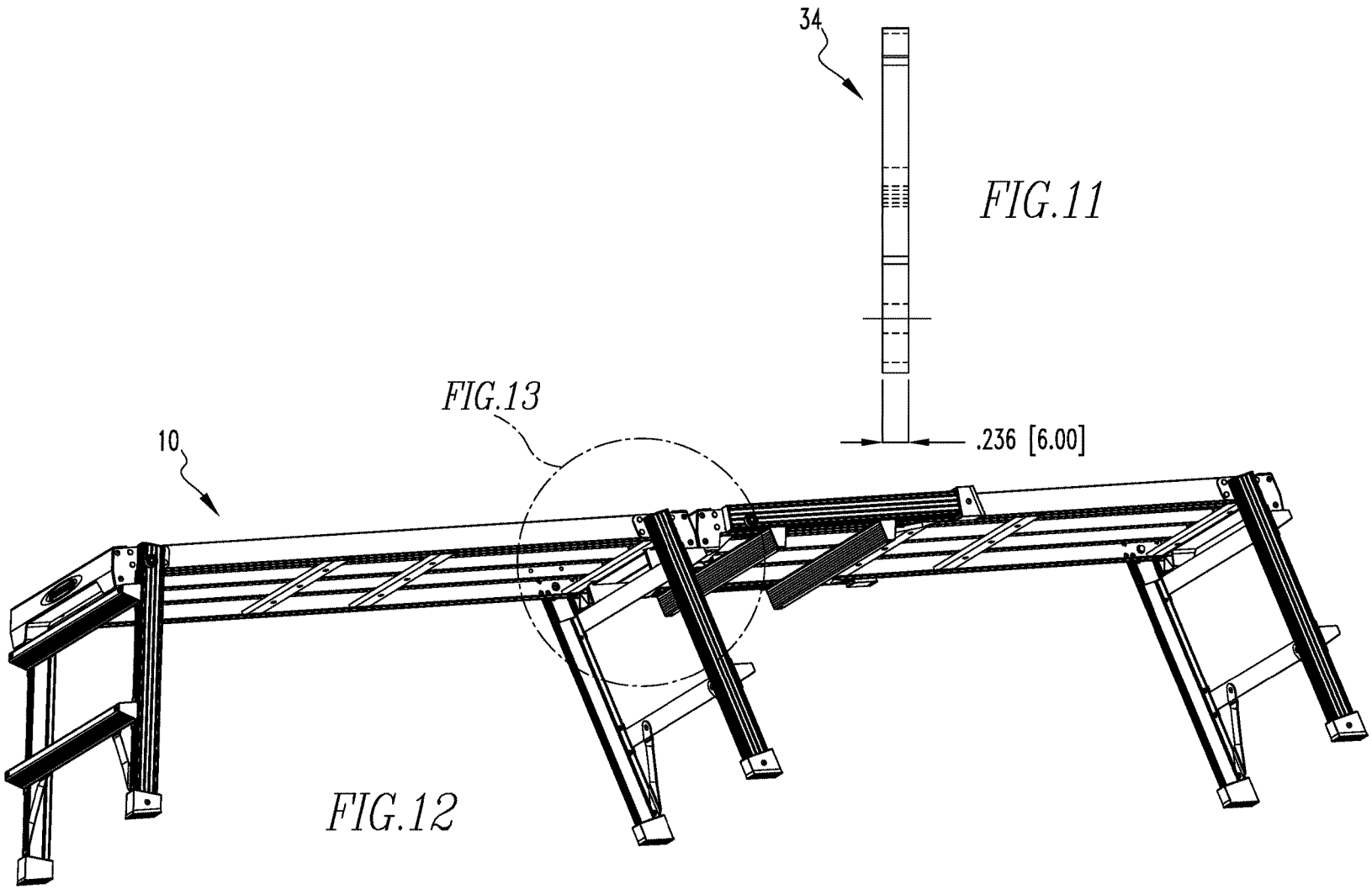
FIG. 11 is a side view of the first bracket.
FIG. 12 is an underside perspective view of the system ready for use with respect to the second scaffold.
FIG. 13 is an exploded view of section A of FIG. 12.
Figure 13:
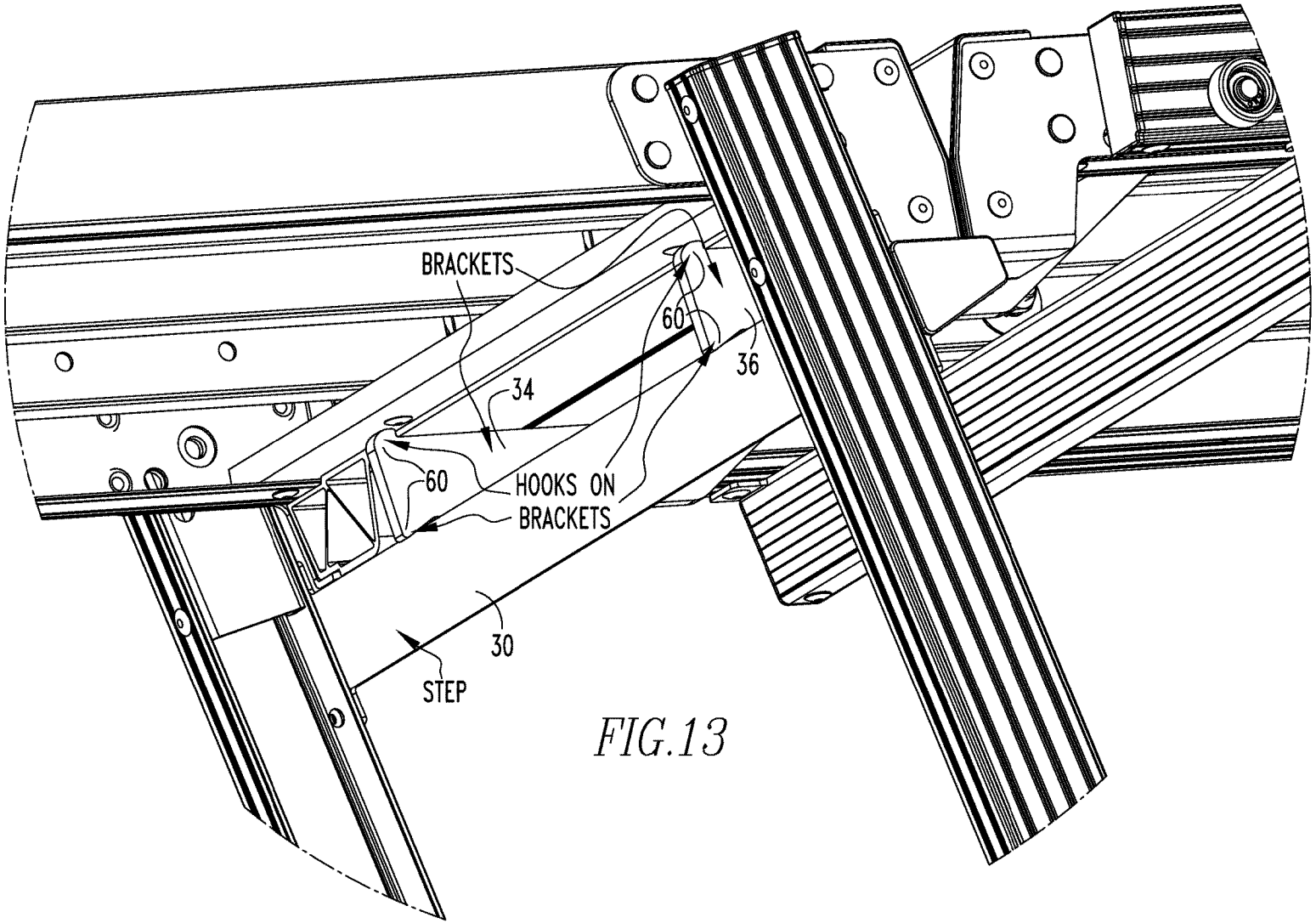
Figure 14:
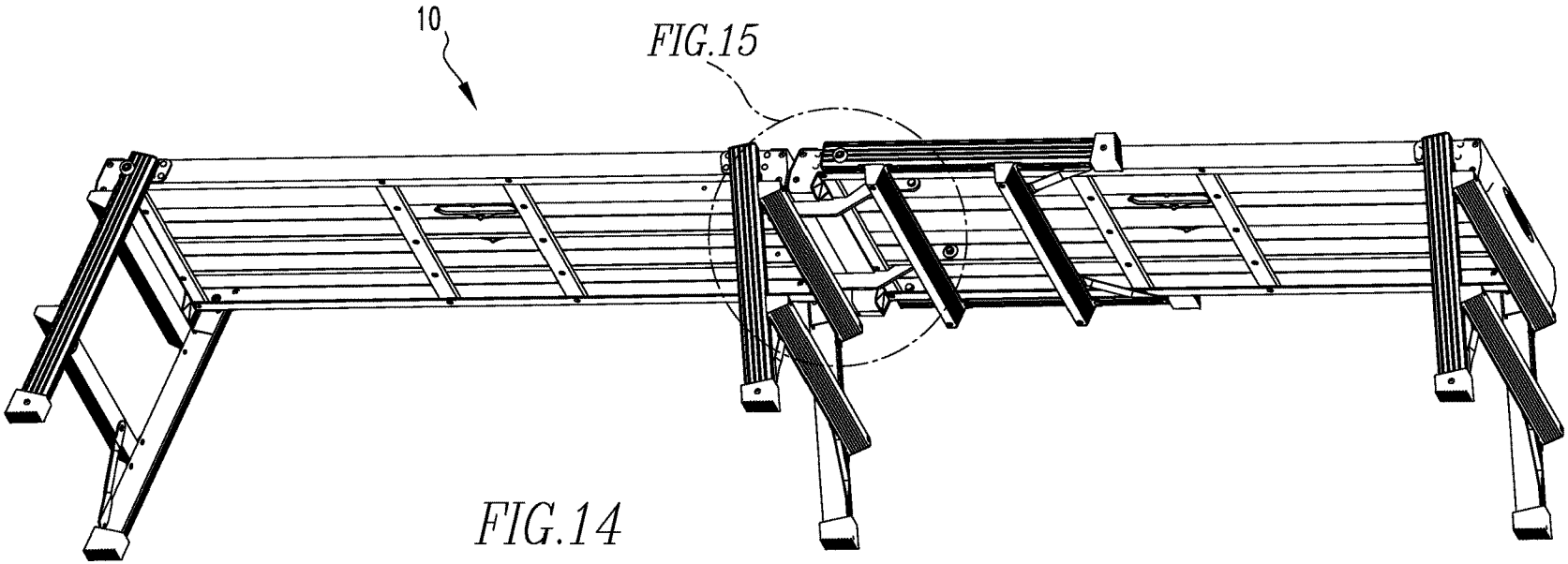
FIG. 14 is an underside perspective view of the system ready for use with respect to the first scaffold.
Figure 15:
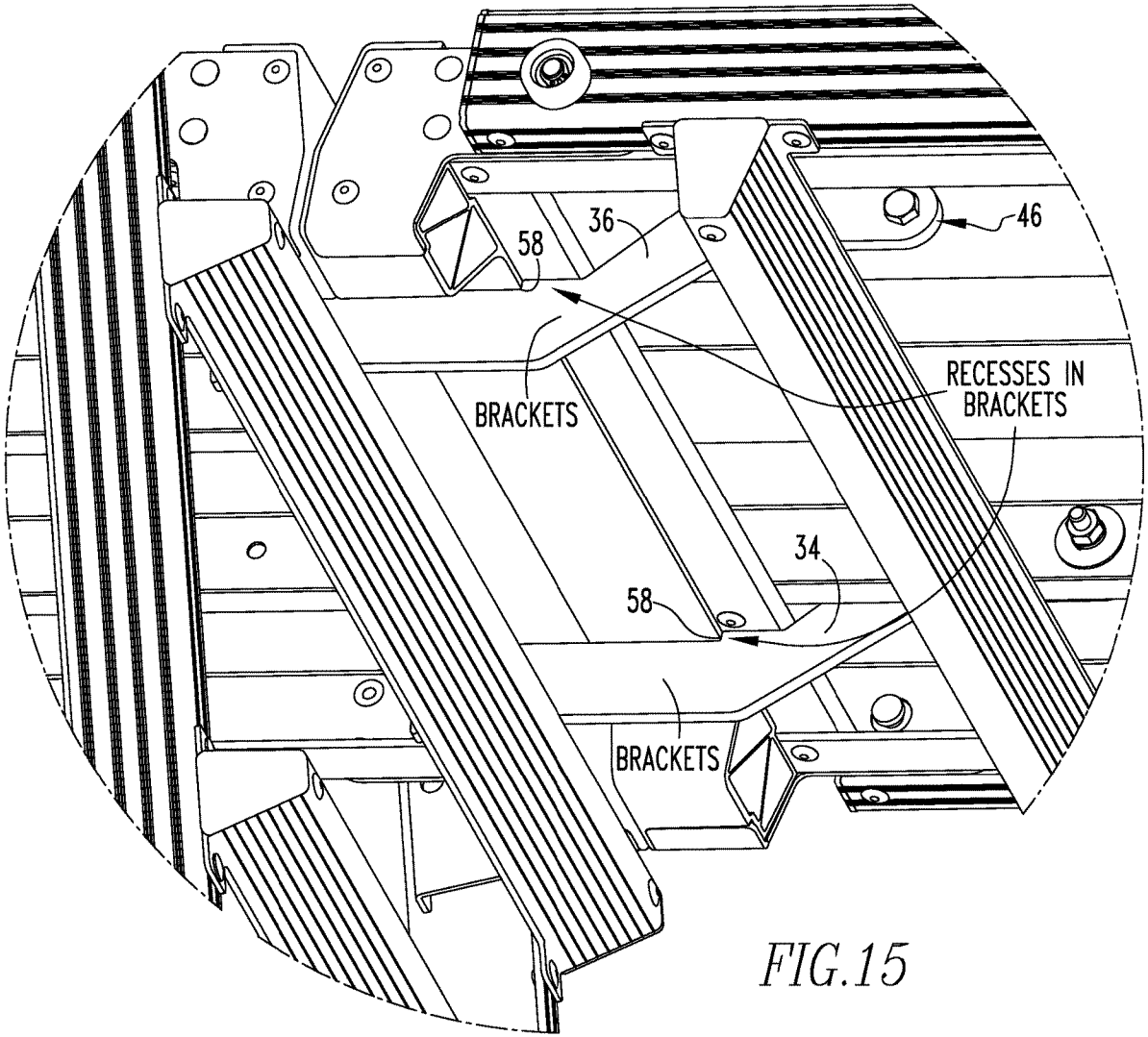
FIG. 15 is an exploded view of section B of FIG. 14.

As shown in FIGS. 9 and 10, the brackets can be unbolted and turned around and then re-bolted to the crossbars in the transfer position so the brackets are now facing inwards, and not extending out beyond the first and 16 of the first scaffold 14. In this way, when the first work platform 12 has both of its leg assemblies in the folded position, as shown in FIG. 9, the brackets will not extend to possibly strike an object while being transported to another location. Similarly, as shown in FIG. 10, where the leg assemblies of the first work platform 12 are in the open position, the brackets are in the transfer position so they do not extend out in a user could possibly bump into them or strike them with an object.

The first scaffold 14 may be between 3 ft. and 6 ft. and preferably 4 ft. in length; may be between 15 inches and 40 inches high and preferably about 21 inches high; and may be between 15 inches and 25 inches wide and preferably about 16 inches wide. Each bracket may be between 0.175 and 0.4 inches wide and preferably about 0.23 inches wide; may be between 7 inches and 17 inches long and preferably about 10 inches long; and may be between 0.7 inches and 3 inches wide and preferable about 1-1.5 inches wide.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A work platform system comprising:

a first work platform comprising:

a first scaffold having a first end and a second end and a plane upon which a user can stand;

a first leg assembly rotatably attached with bolts to the first end of the first scaffold having a first rail and a second rail and a rung attached to the first rail and the second rail, the first leg assembly in a folded position relative to the first scaffold and essentially in parallel the plane of the first scaffold;

a second leg assembly rotatably attached with bolts to the second end of the first scaffold, the second leg assembly in an open position relative to the first scaffold and essentially perpendicular to the plane of the first scaffold;

a first bracket attached to the first scaffold and extending below and outward beyond the first scaffold between the first rail and the second rail of the first leg assembly;

a second bracket attached to the first scaffold and extending below and outward beyond the first scaffold between the first rail and the second rail of the first leg assembly; and a second work platform comprising:

a second scaffold having a first end and a second end and a plane upon which the user can stand;

a third leg assembly rotatably attached with bolts to the first end of the second scaffold having a first rail and a second rail and a rung attached to the first rail and the second rail of the third leg assembly, the third leg assembly in an open position relative to the second scaffold and essentially perpendicular to the plane of the second scaffold, the first end of the second scaffold disposed on the first bracket and the second bracket with the first bracket and the second bracket extending between the first rung of the third leg assembly and the second scaffold, the first bracket and the second bracket disposed on the first rung of the third leg assembly, the first work platform locked to the second work platform through the first and second brackets engaging with the second scaffold and the rung of the third leg assembly; and a fourth leg assembly rotatably attached with bolts to the second end of the second scaffold, the second leg assembly of the second scaffold in an open position relative to the second scaffold and essentially perpendicular to the plane of the second scaffold.

2. The system of claim 1 wherein no pins or bands or any additional components are needed to lock the first work platform with the second work platform.

3. The system of claim 2 wherein the first scaffold has a first crossbar disposed under the first scaffold along a length of the first scaffold and a second crossbar disposed under the first scaffold along a length of the first scaffold in parallel and spaced relation with the first crossbar, the first bracket bolted to the first crossbar and the second bracket bolted to the second crossbar.

4. The system of claim 3 wherein the first bracket has a first portion which is somewhat rectangularly shaped and has a bolthole through which a bolt extends to bold the first bracket to the first crossbar, a second portion which is somewhat rectangularly shaped and extends downward at an angle between 20° and 70° from the first portion, and a third portion that is somewhat rectangularly shaped that extends from the second portion essentially in parallel with the first portion, the third portion extending between the rung of the third leg assembly and the second scaffold and is disposed on the rung of the third leg assembly and on which the first end of the second scaffold is disposed.

5. The system of claim 3 wherein the third portion has a free end that flares outward.

* * * * *